United States Patent [19]

Weiser

[11] Patent Number: 4,590,624

[45] Date of Patent: May 27, 1986

[54] BIRTHING GOWN

[75] Inventor: Georgiann Weiser, Dallas, Oreg.

[73] Assignee: Weiser Design, Ltd., Amity, Oreg.

[21] Appl. No.: 733,076

[22] Filed: May 13, 1985

[51] Int. Cl.[4] ..... A41B 9/00; A41B 9/14; A41D 1/22

[52] U.S. Cl. ..... 2/114; 2/74; 2/76

[58] Field of Search ..... 2/114, 105, DIG. 7, 2/74, 243 B, 76

[56] References Cited

U.S. PATENT DOCUMENTS

| | | | |
|---|---|---|---|
| 2,707,282 | 5/1955 | Paterson | 2/76 |
| 2,722,011 | 11/1955 | Maines | 2/76 |
| 3,708,800 | 1/1973 | Burton | 2/74 |

*Primary Examiner*—Doris L. Troutman
*Attorney, Agent, or Firm*—Robert L. Harrington

[57] ABSTRACT

A birthing gown of the front overlapping variety for expectant mothers in birthing clinics. Separate blouse panels and skirt panels are configured so that when sewn into the gown and without expansion gussets or gathering darts, they permit billowing to accommodate the enlarged breasts and abdomen of the pregnant woman. The skirt panel is sheared along its top edge and connected to the corresponding blouse panel. The left and right front side portions of the gown each comprising interconnected blouse and skirt panels, are releasably fastened together in overlapping relationship with the interconnected edges forming a "waist line" positioned between the breasts and abdomen of the patient.

5 Claims, 5 Drawing Figures

BIRTHING GOWN

FIELD OF INVENTION

This invention relates to a gown having principal application to women patients in a birthing clinic.

BACKGROUND OF INVENTION

The procedure for birthing a child has been dramatically changed with the advent of birthing clinics. Pregnancy studies have determined that pregnant women, in normal health, need not and should not be prohibited from physical exercise. Proper exercise will enhance the delivery process, making the term of pregnancy, the birthing process, and the recovery period far easier for the new mother. Not to be discounted in this recent development, is the rapid accelleration of medical costs. It is this combination of events, i.e. the birthing studies and the hospital/doctor expenses, that have largely encouraged the emergence of the birthing clinics.

A birthing clinic can take many different forms. Typically such clinics promote natural child birth with a minimum of confinement. An expectant mother, ready to give birth, will check into the clinic, be assigned a bed and issued bed clothes. She is monitored by the clinic's staff but otherwise is free to roam the premises, visiting with relatives or other patients until "her time arrives". She is then ushered into a delivery room and assisted by a midwife. With a minimum of fuss and bother she is provided with sufficient bed rest and then released with her new baby to return home. All this will typically occur over a period of one or two days.

The casual atmosphere created in the birthing clinic has generated a desire for an appropriate birthing gown. An appropriate birthing gown will have a combination of features to satisfy comfortability, attractiveness, and birthing compatibility. An expectant mother is uncomfortable enough in the final days of her pregnancy and a loose but nice fitting garment is a must. Whereas the patient is exposed to the public in her bed clothes, she will want to avoid the feeling of being unattractive in the birthing gown anymore than she obviously feels as a result of her "bigness". A gown that looks nice on her is thus very important to the patient. Finally, as the concept of the birthing is intended to leave the patient to her own devices until the last minute, when that last minute arrives it is important that the birthing gown accommodate the birthing process.

BRIEF DESCRIPTION OF THE INVENTION

This invention is believed to satisfy the three above described criteria for a birthing gown, but in a manner that enables the gown to be efficiently and inexpensively produced (obviously a fourth criteria is cost, in that cost is a major consideration in the emergence of the birthing clinic). Very briefly, the gown is produced from five separate panels. One panel forms the back section of the gown including the sleeve and neck areas (hereafter referred to as the back panel); two of the panels provide a skirt section for the front of the gown (hereafter referred to as the left and right skirt panels), and two of the panels provide the blouse section for the front of the gown (hereafter referred to as the left and right blouse panels). These five panels are cut out and sewn together to provide a one piece gown that is of the front overlapping variety i.e. the gown "comes together" at the front, with one side (e.g. the left side) folded over the front of the patient with its side edge fastened to the inside of the right side of the gown (e.g. under the patient's right arm) and the right side of the gown is folded across the front of the patient where it is fastened to the outside of the left side of the gown (e.g. under the patient's left arm).

Using this five panel concept, the blouse panels can be made especially to accommodate the fullness of a pregnant woman's breasts without binding the breasts and without use of unsightly sewing darts. The skirt panels likewise can be gathered in an attractive manner to accommodate the enlarged stomach area. The overlapping sides are easily and quickly opened and closed to facilitate easy robing and disrobing by the patient and provide ready opening at an instants notice in preparation for the birthing process.

The invention will be more clearly understood and appreicated by reference to the following detailed descriptions and drawings.

BRIEF DESCRIPTION OF DRAWING FIGURES

DESCRIPTION OF THE PREFERRED EMBODIMENT

Figure 1:
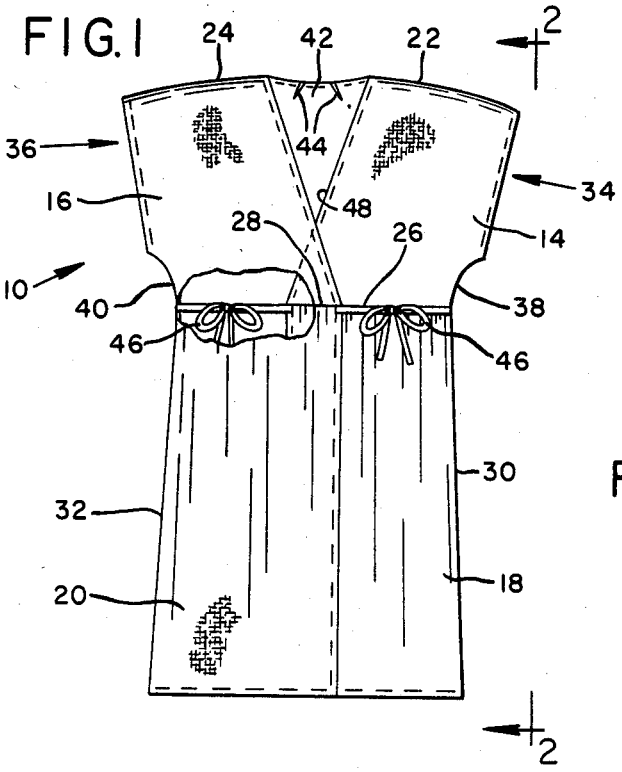
FIG. 1 is a front view of a birthing gown as if worn by an expectant mother, in accordance with the present invention.
Figure 2:
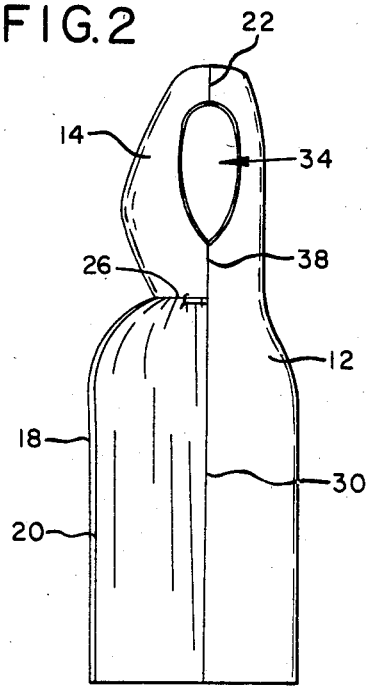
FIG. 2 is a side view of the birthing gown as taken on view lines 2—2 of FIG. 1.

Referring to FIGS. 1 and 2, a gown 10 is shown as if worn by an expectant mother just prior to giving birth. The gown 10 is made up of five panels including a back panel 12, a left blouse panel 14, a right blouse panel 16, a left skirt panel 18 and a right skirt panel 20.

Figure 3:
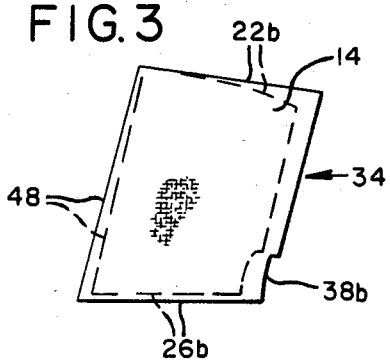
FIG. 3 is a view of the left blouse panel shown in solid lines as a separate panel laid flat, and shown in dash lines as when incorporated into the gown of FIGS. 1 and 2.
Figure 4:
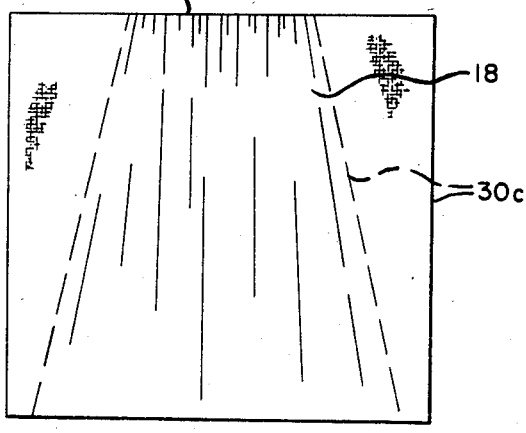
FIG. 4 is a view of the left skirt panel shown in solid lines as a separate panel laid flat, and shown in dash lines as when incorporated into the gown of FIGS. 1 and 2.

Blouse panels 14 and 16 are mirror images and thus only the left blouse panel 14 is shown in FIG. 3. Similarily, skirt panels 18 and 20 are mirror images and thus only the left skirt panel 18 is shown in FIG. 4. It will be understood that the explanations given for the panels of FIGS. 3 and 4 are equally applicable to the right panels except where the differences are pointed out hereafter.

Again referring to FIGS. 1 and 2, it will be noted that the left blouse panel 14 is sewn to the back panel 12 at the shoulder portion of the gown along seam 22, and panel 16 along seam 24. Panels 14 and 16 are respectively sewn to the skirt panels 18 and 20 along seams 26 and 28, and the skirt panels 18 and 20 as respectively sewn to the back panel along seams 30 and 32. Left and right arm openings 34 and 36 are provided between the back panels 12 and blouse panels 14 and 16, and seams 38 and 40 join the back panel 12 and blouse panels 14 and 16 under the arm openings 34 and 36.

Reference is now specifically made to FIG. 2 which illustrates, in profile, the typical shape of the birthing gown as filled out by the expectant-mother. In order for the gown to look nice and feel comfortable, it must accommodate the enlarged breasts and stomach of the patient. A woman in the last stages of pregnancy is very self-conscious of her breasts and stomach, and attractiveness to her means that the gown must accommodate her shape without the impression that the gown is being stretched over her chest and abdomen. To provide enlarging gussets and sewing darts is not the answer because it draws attention to the enlarged areas and increases self-consciousness.

The present invention satisfies the need for a birthing gown that inconspicuously accommodates the enlarged breasts and stomach of a pregnant woman. The invention further provides such a gown that will accommodate the many variations in shapes and sizes of pregnant women, and it accomplishes these objectives in a unique and simple manner that enables the gown to be inexpensively produced. In the first instance, the gown is viewed as having three independent sections which, as has been previously established, are the back section, the blouse section and the skirt section. The back section is provided with a full panel that essentially drapes over the full back area of the wearer. As viewed in FIG. 5, back panel 12 in solid lines illustrates the panel separated from the blouse and skirt panels and laid flat. As seen in dash lines, the upper shoulder edges 22*a* and 24*a* are curled partially over the woman's shoulder to be joined with the blouse panels in forming seams 22 and 24 (FIGS. 1 and 2). A neck opening 42 is formed in part by providing tucks 44 in the back panel as illustrated. The side edges 30*a* and 32*a*, and 38*a* and 40*a*, are curled partially around the sides of the wearer to be joined with the breast and skirt panels in forming seams 30, 32, 38 and 40. Whereas this back panel 12 is not particularly significant by itself, it forms the base panel from which the "accommodating" breast and skirt panels are supported.

A major factor in the design of the illustrated birthing gown is the provision of a "waist" line; i.e., an identifible separation in the front of the gown between the blouse panels and the skirt panels. A pregnant woman having enlarged breasts and stomach has a vary definitive waist line or reduced girth line just below the breasts. In designing the breast and skirt panels for the gown, the joining edges (seams 26 and 28) are provided at this waist line. This is accomplished by providing tie strings 46 at each end of the seams 26 and 28. Referring to FIG. 1, a string 46 on the inside of the gown at the inner end of seam 28 is tied to a string 46 on the outer end of seam 26. Similarily, a string 46 on the outside of the gown at the inner end of seam 26 is tied to a string 46 on the outer end of seam 28. The strings 46 allow adjustment of the gown to the girth of the wearer, and insures the positioning of the seams 26 and 28 at the patient's waist line.

The blouse panels are illustrated in FIG. 3. Again the solid lines illustrate the blouse panel separated from the gown and laid flat, whereas the dash lines illustrate the panel as formed when made part of the gown. Thus edge 22*b* is gathered when worn as shown in its dash position. This is permitted by the curled over edge 22*a* of the back panel 12. The configuration of the blouse panel is such that the free edge 48 is longer than the opposite edge defining the arm opening 34. When edge 26*b* is brought into alignment with the waist band of the patient, a substantial billowing of the blouse panel is permitted as illustrated in the dash lines of FIG. 3 and more dramatically illustrated in the side view of FIG. 2. It will be noted from FIG. 1 that exposure of the breast is avoided by the overlaping arrangement of the panels 14 and 16.

Figure 5:
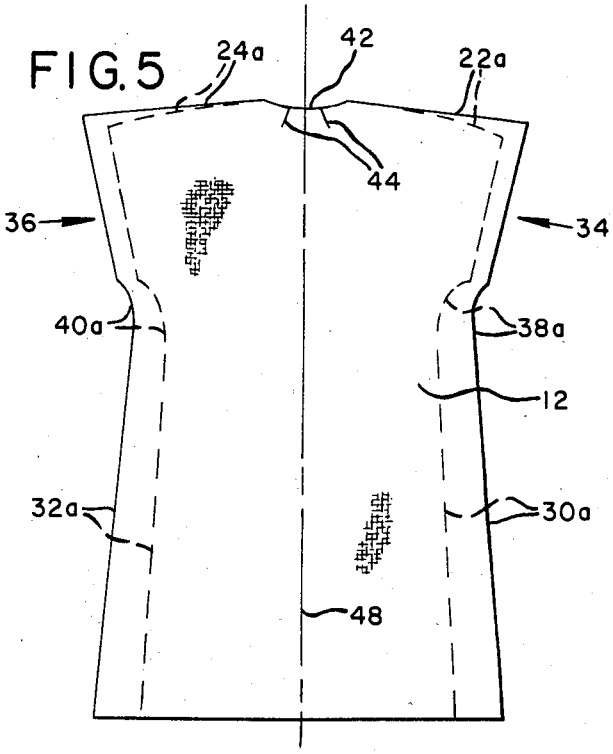
FIG. 5 is a view of the back panel shown in solid lines as a separate panel laid flat, and shown in dash lines as when incorporated into the gown of FIGS. 1 and 2.

Referring now to FIG. 4, the skirt panel 18 is illustrated in the same manner as for FIGS. 3 and 5, with the panel shown in solid lines as if separated from the gown and laid flat, and shown in dash lines as if formed as part of the gown of FIGS. 1 and 2. Essentially panel 18 is a large almost square piece of cloth that is preferably slightly wider than it is long. The top edge 26*c* is sheared, i.e. gathered together in tight pleats, to reduce the top edge width as shown in dash lines to about 40% of the original width shown in solid lines. The sheared edge 26*c* is then sewn to edge 26*b* to thereby provide the expansion for the patient's stomach, protruding outwardly from the waist line as illustrated in FIG. 2. The result is that the skirt attractively and comfortably billows outwardly over the protruding stomach and hangs evenly to give a neat appearance without telltale seams and gussets.

PRODUCTION PROCESS

From the foregoing, it should be apparent that the gown of the invention readily accomplishes all of the heretofore stated objectives for a birthing gown. Production of the gown requires three simple pattern pieces. The back panel pattern piece is laid out on a cloth section and is cut to the configuration of FIG. 5 (in solid lines). Darts 44 are sewn in to form the neck line. The blouse panel pattern piece is used to cut out a left blouse panel 14 (as seen in solid lines in FIG. 3) and then the pattern piece is inverted for cutting out the right blouse panel 16. The pattern piece for the skirt panels is used for cutting out the skirt panels 18 and 20 in a similar manner. The skirt panels are then shreaded to produce the gathered configuration as seen in dash lines in FIG. 4.

The resultant five panels (left and right blouse panels, left and right skirt panels, and the back panel) are then sewn together by aligning edges 24*a* with 24*b*, 22*a* with 22*b*, 26*b* with 26*c* etc. and sewing the edges together to form the seams (22, 24, 26, 28, 30, 32, 38 and 40). The free edges are all faced and the tie strings 46 are tacked on each end of the seams 26 and 28 (the inner string of seam 28 being on the inside, and the inner string of seam 26 being on the outside). The gown is now ready to be worn.

SPECIFIC DIMENSIONS

A gown suitable as a birthing gown was designed with the following dimensions:

Referring to FIG. 5, a back panel 12 was cut out using a half pattern i.e. from the center line 48 to the left as viewed in FIG. 5, with the center line positioned along the fold of a folded yardage of cloth. The half pattern had a length along the center line of 43 inches, a width across the bottom of 15 inches, a length along edge 32*a* of 27½ inches, a sleeve opening length of 12 inches, a length along edge 48 of 2½ inches, a width at the waist line of 13 inches, a neck opening of 4 inches and a shoulder length 24*a* of 13 inches.

Referring now to FIG. 3, the blouse panel 14 was cut out using an invertible pattern having a top edge 22*b* of 13 inches, a bottom edge 26*b* of 14 inches, and a free edge 48 of 17 inches. The sleeve opening was 12 inches and the edge 38*b* was 2½ inches.

Referring now to FIG. 4, the top edge 26*c* was made 30 inches long and sheared down to 12½ inches. Edge 30*c* was 28 inches and the opposite free edge 30 inches.

The bottom edge was made 32 inches long. The free edge being slightly longer than edge 30*c*, allows for a slight rise in the front of the gown.

Whereas the dimensions are given as a specific example only of a birthing gown produced in accordance with the present invention, it will be appreciated that numerous variations are possible without departing from the scope of the invention which is defined in the claims appended hereto.

I claim:

1. A birthing gown comprising; a back panel, left and right blouse panels and left and right skirt panels, said back panel forming the back of the gown, the left blouse panel and left skirt panel interconnected along lateral ajoining edges and forming the left side of the front of the gown having a free side edge and an interconnected side edge with the back panel, and the right blouse panel and right skirt panel interconnected along lateral ajoining edges and forming the right side portion of the front of the gown having a free side edge and an interconnected side edge with the back panel, said left and right side portions having overlaping relationship, and the improvement that comprises;

each of said left and right blouse panels configured when laid flat and without stitching to be larger than the breast area of the gown, thereby producing a billowing of the blouse panels for accommodating the patient's breasts with the edges of the blouse panels interconnected to the back panel and corresponding skirt panels, each of said left and right skirt panels configured when laid flat and without stitching to be larger than the skirt area of the gown, with the top edge sheared to produce pleating of the skirt panels and to allow billowing of the skirt panels to accommodate the patient's abdomen, said interconnection of the left blouse panel and left skirt panel, and right blouse panel and right skirt panel cooperatively defining a waist line for location between the breasts and abdomen of the patient, and fastening means for fastening the front side portions of the gown together in overlaping relationship with the waist line located between the patient's breasts and stomach.

2. A birthing gown as defined in claim 1 wherein said back panel, left and right blouse panels, and left and right skirt panels are separate cloth pieces interconnected at the ajoining edges by sewn seams.

3. A birthing gown as defined in claim 2 wherein the fastening means are tie strings tacked to inner and outer positions on the interconnected edges of the blouse and skirt panels.

4. A birthing gown as defined in claim 3 wherein the sheared edge of each skirt panel reduces the top edge length to about 40% of the unsheared length.

5. A process for producing a birthing gown that comprises;

cutting out from a cloth piece a back panel having shoulder edges, neck and arm opening edges and side edges, cutting out from second and third cloth pieces, left and right blouse panels configured to have a first side edge, an opposite free side edge and top and bottom edges diverging from the first side edge to the free side edge, cutting out from fourth and fifth cloth pieces, left and right skirt panels having top, bottom and side edges, shearing the top edge to substantially reduce their width along the top edges and thereby to develope pleatings in the skirt panels, sewing the sheared top edge of each skirt panel to the bottom edge of the corresponding blouse panel to produce right and left front side portions, and sewing the back panel along the side edges and shoulder edges to the corresponding side edges and shoulder edges of the front side portions, and tacking tie strings at the seams between the blouse and skirt panels for drawing the front side portions together with said seams positioned at the waist line between the breast and abdomen of a patient.

* * * * *